United States Patent [19]

McGill et al.

[11] Patent Number: 4,951,583

[45] Date of Patent: Aug. 28, 1990

[54] THERMAL DESTRUCTION SYSTEM FOR TOXIC SUBSTANCES

[75] Inventors: Eugene C. McGill, Skiatook; Bob R. Cartwright, Bixby, both of Okla.

[73] Assignee: McGill Environmental Systems, Inc., Tulsa, Okla.

[21] Appl. No.: 385,896

[22] Filed: Jul. 27, 1989

[51] Int. Cl.[5] ..... F23G 7/04

[52] U.S. Cl. ..... 110/346; 110/185; 110/190; 110/237; 110/238

[58] Field of Search ..... 110/237, 238, 346, 185, 110/186, 190

[56] References Cited

U.S. PATENT DOCUMENTS 4,419,943 12/1983 Faurholdt ..... 110/237

4,850,290 7/1989 Benoit et al. ..... 110/237 X

*Primary Examiner*—Edward G. Favors

*Attorney, Agent, or Firm*—Bill D. McCarthy

[57] ABSTRACT

A process for the thermal destruction of waste materials of unknown volatility disposed within a container, the process comprising the steps of (a) placing the open container in a combustion chamber of a pyrolysis furnace; (b) providing the pyrolysis furnace with a reducing atmosphere and raising the temperature in the pyrolysis furnace to remove volatile components of the material until a preselected temperature is reached; (c) maintaining the temperature in the pyrolysis furnace while controllably adding air until all the combustible materials are pyrolyzed; (d) continuing to add air during a final oxidation period to achieve combustion of all nonvolatile combustible materials; and (e) processing all volatilized materials in a secondary combustor fluidly communicating with the pyrolysis furnace.

21 Claims, 5 Drawing Sheets

THERMAL DESTRUCTION SYSTEM FOR TOXIC SUBSTANCES

BACKGROUND OF THE INVENTION

1. Field of the Invention

The present invention relates to a system for thermal destruction of waste materials, and more particularly but not by way of limitation, to a system for thermal destruction of toxic waste materials having unknown volatility.

2. Discussion

Recent concern over destruction of hazardous waste has created a need for technology to safely and efficiently dispose of such waste. In many instances, the waste is stored in steel drums and one does not know the composition or toxic properties of the waste. The prior art processes for the destruction of hazardous waste has generally required substantial knowledge of the physical and chemical properties of the waste to insure that disposal of the waste does not create harm or deleterious effects on the equipment, personnel and the environment. That is, the prior art processes as a whole require that the waste material be examined and classified before incineration (i.e. whether the waste is solid, pasty, liquid or perhaps gas and the calorific values of the waste); and the process and equipment must be adapted to handle specific waste or refuse problems.

For example, a drum filled with gasoline might explode if placed in a hot combustion chamber or explode after being heated if the combustion chamber is initially cold. Likewise, a container of gasoline or other volatile substances would begin to boil and release combustible material as such were heated; whereas another substance, e.g. carbon, would not release combustible materials.

As can be appreciated, the requirements of obtaining knowledge of the physical and chemical properties of a hazardous waste material increases the exposure of personnel to such waste. Thus, it would be highly desirable if one could provide a safe and efficient thermal destruction system for substances of unknown toxicity, without the requirement as to having knowledge of the physical and chemical properties of such substances, which was capable of detecting problems of volatilization and other downstream problems, and which, at the same time, substantially reduced or eliminated the need of handling such materials by personnel. It is to such a system that the present system is related.

SUMMARY OF THE INVENTION

The present invention provides an improved process for the safe and efficient destruction of toxic substances of unknown volatility. Broadly, the present invention relates to a process which can safely and efficiently thermally destroy waste materials of unknown volatility which are stored in containers, the process including the steps of (a) placing an open container in a pyrolysis furnace; (b) providing the pyrolysis furnace with a reducing atmosphere and varying the temperature in the pyrolysis furnace until all volatile components of the material are driven off; (c) increasing the temperature in the pyrolysis furnace until all combustible materials are destroyed; and (d) processing all volatilized materials in a secondary combustor fluidly communicating with the primary combustor.

More specifically, in carrying out the improved process for the safe and efficient thermal destruction of toxic substances of unknown volatility of the present invention, an opening is provided in a container filled with unknown materials so as to provide a vapor outlet in the container. The opened container is placed in the pyrolysis furnace. The pyrolysis furnace, which is in vapor communication with a secondary combustor, is provided with a variable radiant heat source. Once the container has been placed in the pyrolysis furnace, the pyrolysis furnace is purged to provide a safe atmosphere in the combustion chamber, and the variable heat source is activated. The temperature in the pyrolysis furnace is raised in the inert atmosphere to provide an overhead vapor stream which is passed to the secondary combustor. The temperature of the overhead vapor stream is monitored and the variable heat source is regulated in response to the temperature of the overhead vapor stream so that the overhead vapor stream is caused to increase at a controlled rate.

Once the volatiles have been removed, a controlled amount of air is injected into the container by a fluid injection lance which is advanceable into the container through the opening thereof, the advancement of the fluid injection lance being such to permit the lance to penetrate the materials in the container at a predetermined rate. While the air is being injected into the container, the temperature of the pyrolysis furnace is controlled and a reducing atmosphere maintained at a predetermined temperature for a period of time effective to allow all combustible materials in the container to be removed.

After the container has been maintained in the reducing atmosphere within the pyrolysis furnace for the predetermined time effective to remove all volatile combustible materials contained within the container, remaining coke will be combusted in an oxidizing atmosphere before the variable heat source is deactivated and cooling steam is injected into the pyrolysis furnace to cool same. Once cooled, the pyrolysis furnace is opened and the container, free of all volatile and combustible materials, can safely be removed from the pyrolysis furnace.

A pyrolysis furnace, into which containers containing the unknown material to be destroyed are placed, comprises a housing having a combustion chamber, a heater source disposed within the combustion chamber, and an opening through which containers can be positioned into the combustion chamber. The pyrolysis furnace is also provided with a closure assembly for closing the opening in the housing so that a gas-tight seal is formed therebetween. That is, the closure assembly, which supports the containers thereon, is secured within the opening of the housing and secured thereto such that a fluid tight seal is formed therebetween.

The pyrolysis furnace is in fluid communication with a secondary combustor via a vapor outlet, and is further provided with a fluid injection lance which i advanceable through the housing and into the waste material in the container at a controlled rate. The fluid injection lances, which supply air to the waste material in the container, and thus the pyrolysis furnace, are controlled such that controlled amounts of air are injected into the waste material to insure efficient and effective pyrolysis and/or combustion of the waste material. That is, the fluid injection lance is operably connected to a power assembly so that the advancement of the fluid injection lance into the container is such that the depth of penetration of the fluid injection lance into the waste material is controlled at a predetermined rate in response to a timing circuit to insure that the pyrolysis of the waste material is at a rate which does not overload the secondary combustor.

The closure assembly, which supports the containers thereon, is connected to and supported by a rail truck assembly having a power actuated tilt table and lift. Thus, the closure assembly can be positioned within the opening of the housing by activation of the rail truck assembly. Thereafter, the closure assembly can be secured in place by activation of a locking assembly.

An object of the present invention is to provide a safe and efficient system for the thermal destruction of toxic waste materials having unknown volatility.

Another object of the present invention, while achieving the before-stated object, is to provide a safe and efficient batch system for the thermal destruction of volatile, flammable materials.

Yet another object of the present invention, while achieving the before-stated objects, is to provide an improved pyrolysis furnace for the safe and efficient thermal destruction of waste materials of unknown volatility.

Other objects, advantages and features of the present invention will become clear when the following description is read in conjunction with the accompanying drawings and appended claims.

DESCRIPTION OF THE INVENTION

It is to be understood that the present invention is not limited in application to the details of construction and arrangement of components described below and illustrated in the accompanying drawings. Also, it should be understood that the various details of construction, such as various valving, vessel internals and control mechanisms are not included or described herein as these will be clearly understood by persons of ordinary skill in the art and are considered unnecessary for completeness of the disclosure herein provided.

Figure 1:
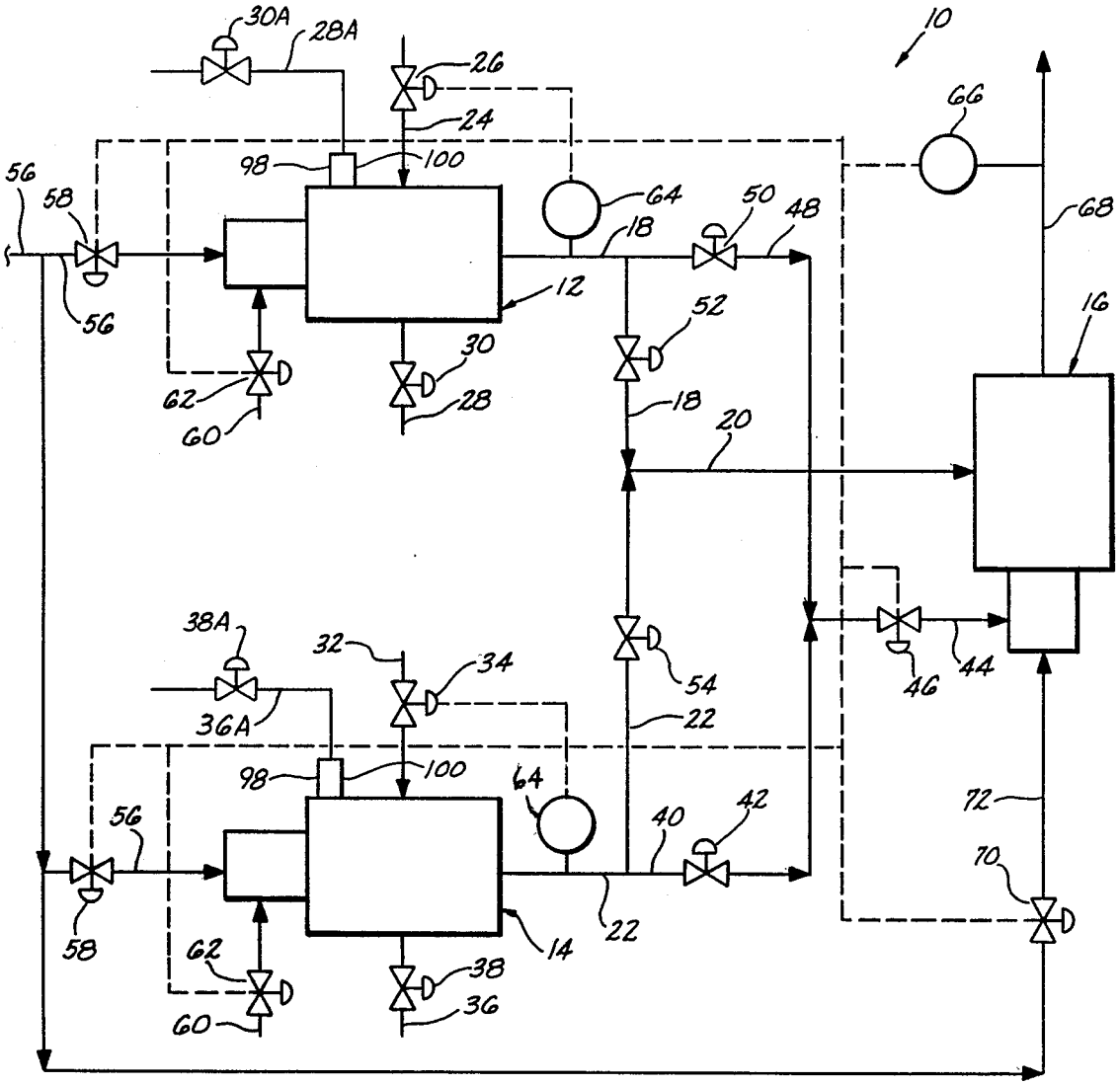
FIG. 1 is a flow diagram depicting the thermal destruction system of the present invention which is for the safe and efficient destruction of toxic substances of unknown volatility.

Referring now to the drawings, and more particularly to FIG. 1, depicted schematically therein is a system 10 for the safe destruction of toxic substances of unknown volatility. The system 10 is provided with two pyrolysis furnaces 12 and 14, and a secondary combustor 16. Each of the pyrolysis furnaces 12 and 14 is adapted to receive one or more containers, such as barrels, which contain waste materials to be disposed of; and the secondary combustor 16 is in fluid communication with an outlet of the pyrolysis furnaces 12 and 14 so that an overhead vapor stream produced by volatilization of the volatile components in the waste material during thermal destruction of the waste material in either the pyrolysis furnace 12 or the pyrolysis furnace 14 is passed to the secondary combustor 16 for processing. That is, fluid communication is provided between the pyrolysis furnace 12 and the secondary combustor 16 via lines or conduits 18 and 20 so that the overhead vapor stream produced in the pyrolysis furnace 12 can be passed to the secondary combustor 16. Similarly, fluid communication is provided between the pyrolysis furnace 14 and the secondary combustor 16 via lines 22 and 20 so that the overhead vapor stream produced in the pyrolysis furnace 14 can be passed to the secondary combustor 16.

The system 10 is a batch destruction process which can be operated as a semi-continuous system because of the relationship and the use of the pyrolysis furnaces 12 and 14. That is, when the pyrolysis furnace 12 is filled and in operating condition, the pyrolysis furnace 14 is in the "cool down" stage; and when the pyrolysis furnace 14 is filled and in operating condition, the pyrolysis furnace 12 is in the "cool down" stage. To effect cooling of the pyrolysis furnace 12 during the "cool down" stage, cooling fluid such as steam is injected into the combustion chamber of the pyrolysis furnace 12 via line 24 and valve 26; and sweep air is introduced into the pyrolysis furnace 12 via line 28 and valve 30. Similarly, during the "cool down" of the pyrolysis furnace 14, cooling steam is injected into the combustion chamber of the pyrolysis furnace 14 via line 32 and valve 34; and sweep air is introduced into the pyrolysis furnace 14 via line 36 and valve 38. Additionally, lance air, discussed hereinbelow, is introduced to the pyrolysis furnace 12 via line 28A and valve 30A; and to the pyrolysis furnace 14 via line 36A and valve 38A.

When the pyrolysis furnace 12 is in the operational mode, sweep air from the pyrolysis furnace 14 is utilized as combustion air for the burner of the secondary combustor 16. That is, sweep air is passed from the pyrolysis furnace 14 to the burner of the secondary combustor 16 via lines 22 and 40, air valve 42, line 44 and air valve 46. On the other hand, when the pyrolysis furnace 14 is in the operational mode, sweep air from the pyrolysis furnace 12 is passed to the burner of the secondary combustor 16 for use as the combustion air for the burner via lines 18 and 48, air pyrolysis furnace 14 is filled and in operating condition, and the pyrolysis furnace 12 is in the "cool down" stage. To effect cooling of the pyrolysis furnace 12 during the "cool down" stage, cooling steam is injected into the combustion chamber of the pyrolysis furnace 12 via line 24 and valve 26; and sweep air is introduced into the pyrolysis furnace 12 via line 28 and valve 30. Similarly, during the "cool down"

of the pyrolysis furnace 14, cooling steam is injected into the combustion chamber of the pyrolysis furnace 14 via line 32 and valve 34; and sweep air is introduced into the pyrolysis furnace 14 via line 36 and valve 38.

The use of the two pyrolysis furnaces 12 and 14, while being operated as a batch process, enables one to semi-continuously operate the system 10 in that one of the primary combustors can be operational while the other is in a "cool down" mode or state. Because of the relationship of the pyrolysis furnaces 12 and 14 with the secondary combustor 16, and the effective temperature control of the pyrolysis furnaces 12 and 14 (based upon the load to the secondary combustor 16), the pyrolysis furnaces 12 and 14 provide a safe and efficient method for handling containers filled with unknown waste materials. That is, the temperatures in the pyrolysis furnaces 12 and 14 are first raised to a temperature in a reducing atmosphere until all volatile materials are driven off, and thereafter the temperature is controlled in an oxidizing atmosphere.

The temperature of the overhead stream passing from either the pyrolysis furnace 12 or the pyrolysis furnace 14 to the secondary combustor 16 is measured and the heat supply to the pyrolysis furnaces 12 and 14 is controlled in response to the temperature of the overhead stream. Thus, control of the pyrolysis furnaces 12 and 14 is through recognition of the temperature of the overhead stream, as well as problems of volatilization and other downstream problems which might occur in the secondary combustor 16. That is, the unique design of the system 10 provides a uniform load to the secondary combustor 16 which allows the secondary combustor 16 to be as small as possible and to operate near peak thermal efficiency.

Figure 2:
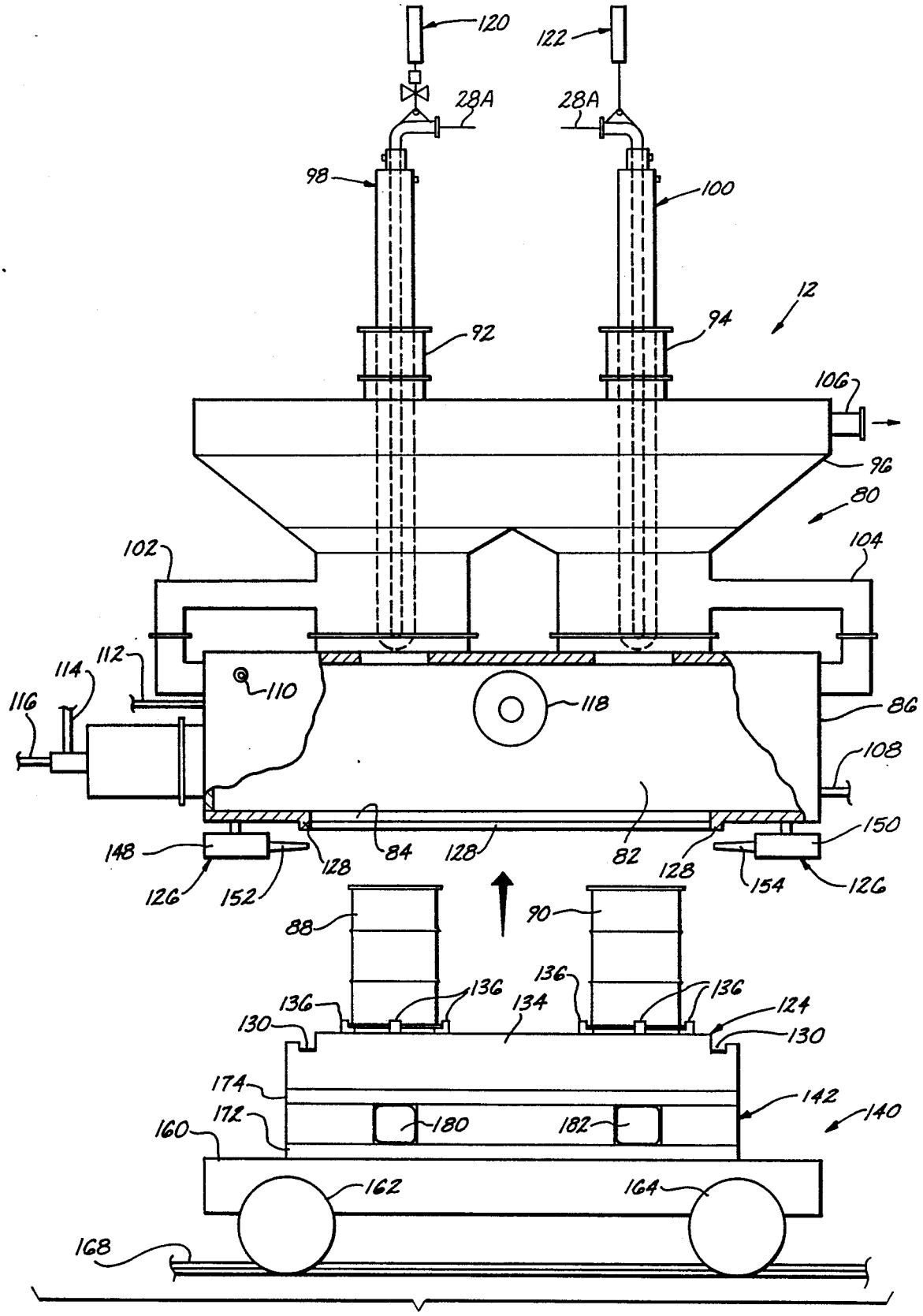
FIG. 2 is a partially cutaway, elevational view of a pyrolysis furnace constructed in accordance with the present invention and illustrating a pair of containers supported on a rail truck assembly prior to placement of the containers into a combustion chamber of the pyrolysis furnace.
Figure 3:
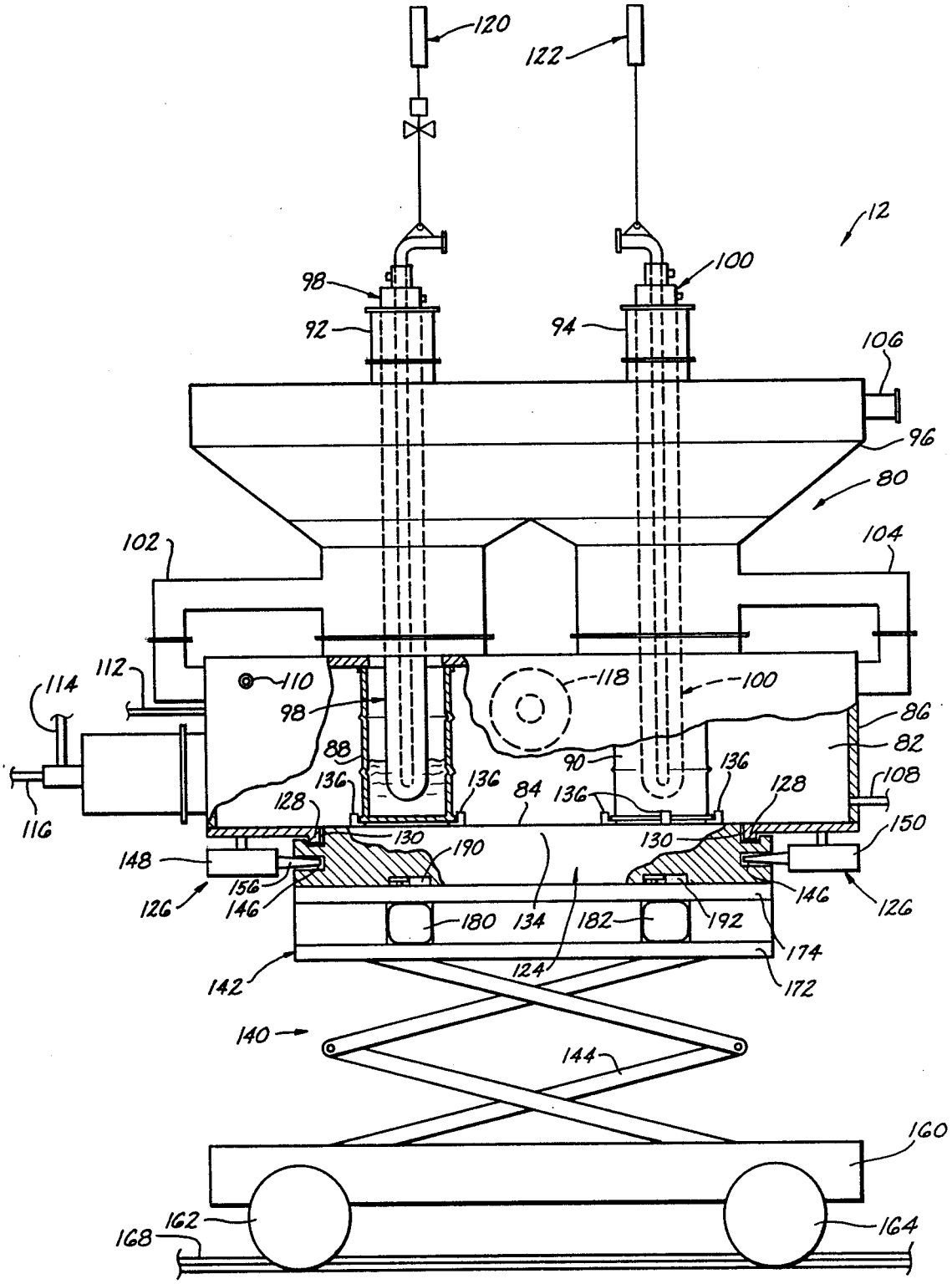
FIG. 3 is a partially cutaway, elevational view of the pyrolysis furnace wherein a tilt table and lift of the rail truck assembly has been activated and moved to a raised position for placement of a closure assembly into closing and sealing relationship with the opening of the combustion chamber of the pyrolysis furnace.
Figure 4:
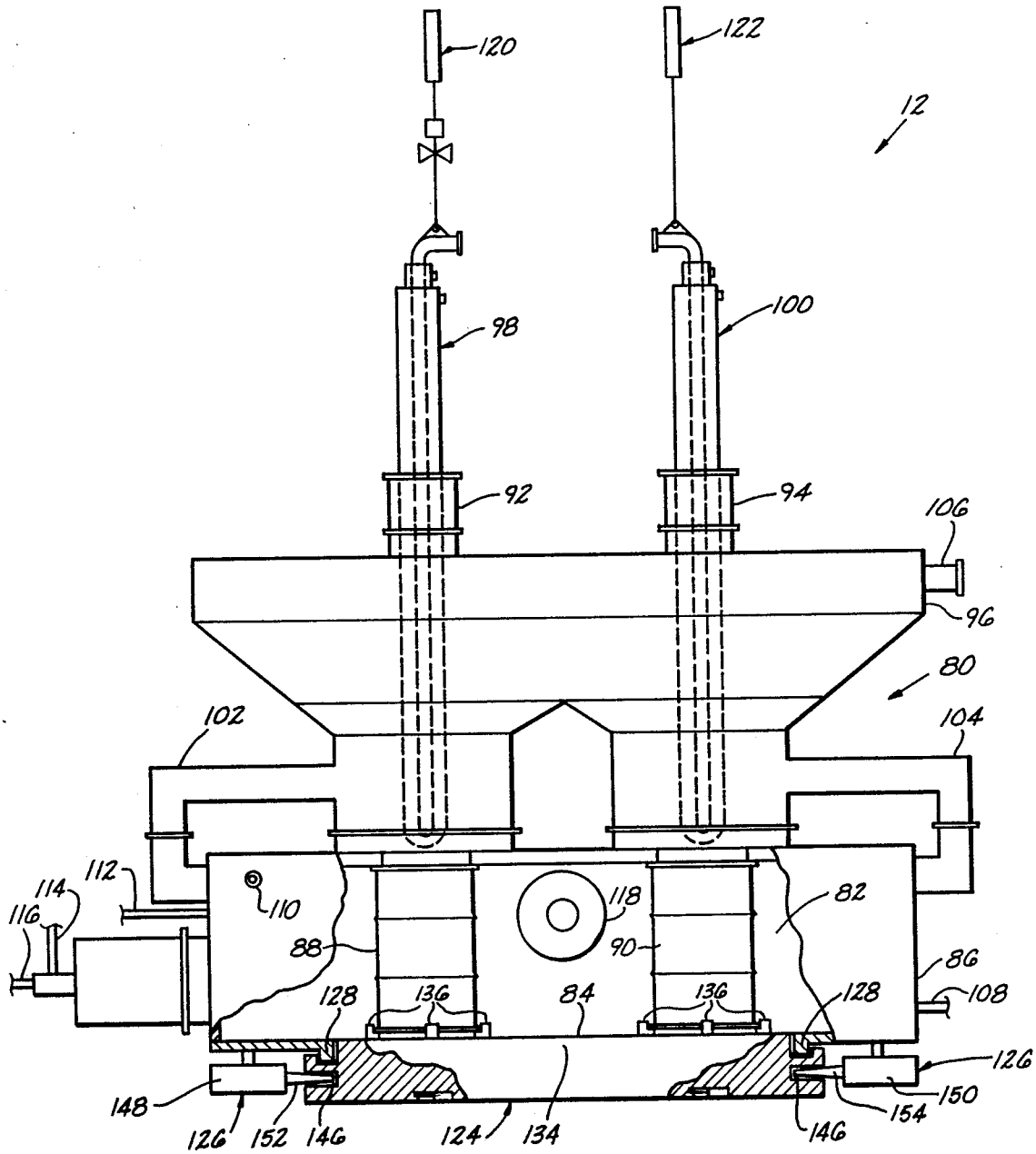
FIG. 4 is a partially cutaway, elevational view of the pyrolysis furnace wherein containers have been positioned within the combustion chamber, and the closure assembly has been secured.

To effect the thermal destruction of hazardous waste of unknown toxicity and volatility in the system 10 of the present invention, a container, such as a barrel (see FIGS. 3 and 4), is positioned within a combustion chamber of one of the primary combustors, such as the combustion chamber of the pyrolysis furnace 12. Prior to placing the container in the combustion chamber of the pyrolysis furnace 12, the upper portion of the container is removed so that an opening is formed within the container to provide a vapor outlet. The pyrolysis furnace 12, which is illustrated in detail in FIGS. 2–4, is then sealed to provide a fluid or gas-tight enclosure.

The pyrolysis furnace 12 is provided with a radiant heat source for elevating the temperature of the combustion chamber of the pyrolysis furnace 12 (and thus the waste material within the container), and a vapor outlet which communicates with the secondary combustor 16 (FIG. 1) via lines 18 and 20. A valve 52 is positioned within line 18, and, during operation of the pyrolysis furnace 12, the valve 52 is maintained in an open position so that volatile materials vaporized in the pyrolysis furnace 12 can flow to the secondary combustor 16 as an overhead vapor stream to induce a load on the secondary combustor 16. However, when the pyrolysis furnace 12 is in the "cool down" mode and the pyrolysis furnace 14 is in the operational mode, the valve 52 is closed.

Similarly, the pyrolysis furnace 14 is provided with a radiant heat source for elevating the temperature of the combustion chamber of the pyrolysis furnace 14 (and thus the waste material within the containers), and a vapor outlet communicates with the secondary combustor 16 via lines 22 and 20. A valve 54 is positioned within line 22 and, during operation of the pyrolysis furnace 12 the valve 54 is closed. However, when the pyrolysis furnace 12 is in the "cool down" mode and the pyrolysis furnace 14 is operational and on stream, the valve 54 is in the open position so that volatile materials vaporized in the pyrolysis furnace 14 can flow to the secondary combustor 16 as an overhead vapor stream to induce a load on the secondary combustor 16.

When the container has been positioned within the combustion chamber of the pyrolysis furnace 12, and the pyrolysis furnace 12 sealed, the pyrolysis furnace 12 can be purged with an inert sweep gas (but air can also be used in some circumstances) and the pressure in the pyrolysis furnace 12 reduced. Regulatory requirements usually decree that combustion of waste materials be performed under negative pressure conditions, that is, slight vacuum conditions. This negative (below atmospheric) pressure is maintained throughout all of the operating cycle of the pyrolysis furnace 12. This will also apply to the operation of the secondary combustor 16 during its active operating cycle.

The purging of the pyrolysis furnace 12 is achieved to insure that substantially all of the oxygen and/or combustibles has been removed therefrom, allowing a safe start or ignition of the radiant burner. The amount of the combustion air supplied to the radiant burner will be substantially consumed by the fuel. Thus, not only is the danger of explosions eliminated because of the absence of excess oxygen in the pyrolysis furnace 12 during the initial heating stage, but for reasons which will be hereinafter set forth, the temperature of the pyrolysis furnace 12 is controlled so that the secondary combustor 16 does not overload during the initial heating stage.

The combustion chamber of the pyrolysis furnace 12 is filled with suitable containers, such as barrels, containing waste material possibly having volatile, flammable components. Fuel is introduced to a radiant burner of the pyrolysis furnace 12 via line 56 and fuel valve 58; and combustion air is supplied to the radiant burner of the pyrolysis furnace 12 via line 60 and air valve 62. As previously stated, the amount of combustion air supplied to the radiant burner is controlled so that substantially all of the oxygen is consumed during the burning of the fuel by the radiant burner.

The temperature controller 64 now begins a controlled temperature increase in the pyrolysis furnace 12 in the reducing environment until the desired destruction temperature is achieved, such as from about 1,500 degrees Fahrenheit to about 1,800 degrees Fahrenheit.

As volatile materials begin to vaporize in the pyrolysis furnace 12 due to the increased temperature, an overhead vapor stream is produced which is passed via line 18, valve 52 and line 20 to the secondary combustor 16 to induce a load on the secondary combustor 16. The temperature in the pyrolysis furnace 12 is raised in a controlled manner via temperature controller 64 which monitors the temperature of the overhead vapor stream passing from the pyrolysis furnace 12 to the secondary combustor 16. The valve 52 will be open when the pyrolysis furnace 12 is in an operating state or mode, but will be closed when the pyrolysis furnace 12 is in the "cool down" stage, and the pyrolysis furnace 14 has been brought on stream. On the other hand, valve 50 in line 48 will be closed when the pyrolysis furnace 12 is in operating state so that fluid flow is prevented through line 48 and to the burner of the secondary combustor 16. However, as previously stated, valve 52 will be closed and valve 50 opened when the pyrolysis furnace 12 is in the "cool down" stage.

The secondary combustor 16 is held at a constant temperature by temperature controller 66. Temperature controller 66 is operated in response to the temperature of the overhead stream travelling through line 68 from the secondary combustor 16. When no external load exists on the secondary combustor 16, the temperature of the secondary combustor 16 is maintained by the temperature controller 66 which controls fuel valve 70 for supplying fuel to a burner of the secondary combustor 16 via line 72. Combustion air for the burner of the secondary combustor 16 is supplied from the purging air introduced into the pyrolysis furnace 14 which flows from the pyrolysis furnace 14 via lines 22 and 40, air valve 42, line 44 and air valve 46 to the burner of the secondary combustor 16.

As volatile materials are generated in the pyrolysis furnace 12, and an overhead vapor stream is produced which introduces a load on the secondary combustor 16, temperature controller 66 will start to close fuel valve 70 to prevent the temperature in the secondary combustor 16 from rising above a predetermined set point. If the load on the secondary combustor 16 is so great that closing of the fuel valve 70 to its minimum point cannot prevent the temperature within the secondary combustor 16 from exceeding the set point of the temperature controller 66, the temperature controller 66 will open air valve 46 so that sufficient cooling air can be injected into the secondary combustor 16 via lines 22 and 40, valve 42, line 44 and air valve 46 to sufficiently "cool down" the secondary combustor 16, and bring the temperature controller 66 back on control.

In the event the air valve 46 reaches its wide open position, then the temperature controller 66 will override temperature controller 64 and lower the temperature in the pyrolysis furnace 12 until the load on the secondary combustor 16 is decreased to an acceptable level. If temperature controller 64 is unable to adequately lower the temperature in the pyrolysis furnace 12 quickly, quench steam will be introduced by the opening of valve 26 responsive to commands of the temperature controllers 64, 66. When the load on the secondary combustor 16 has been reduced to a satisfactory level, the temperature controller 64 is allowed to begin its controlled increase of temperature in the pyrolysis furnace 12 once again. The increasing of the temperature of the pyrolysis furnace 12, without creating an excess load on the secondary combustor 16, continues until all of the volatile components of the waste material in the pyrolysis furnace 12 have been removed. Thereafter, future temperature increases in the pyrolysis furnace 12 may occur in the presence of oxygen without danger of overload on the secondary combustor 16 or danger of an explosion in the pyrolysis furnace 12.

After the temperature in the pyrolysis furnace 12 has reached a temperature level such that substantially all of the volatile components of the waste material have been volatilized, and while the pyrolysis furnace 12 has a reducing or inert atmosphere, the lance advancement cycle of the present invention commences. The pyrolysis furnace 12 is provided with fluid injection lances 98 and 100 which will be described more fully with reference to FIGS. 2–4 hereinbelow. For the present discussion it will be sufficient to note that such fluid injection lances 98, 100 are air injection devices which can mechanically and controllably penetrate the waste material containers at a predetermined and stated rate so as to progressively expose the waste material to combustion air in layers. These fluid injection lances 98, 100 are provided lance air via the line 28A and valve 30A which is controlled by a timing circuit.

The fluid injection lances 98 and 100 are activated once the temperature in the pyrolysis furnace 12 reaches a predetermined set point above about 1,500 degrees Fahrenheit, the set point being usually between about 1,500 degrees Fahrenheit to about 1,800 degrees Fahrenheit. As the temperature in the pyrolysis furnace 12 reaches the selected set point, the timing circuit is activated and the fluid injection lances 98, 100 are moved to a first inserted position which is defined as where the fluid injection lances 98, 100 extend into the container approximately one third of the container length. The lance air is no started at a first air rate via the valve 30A which is partially opened. After a predetermined time, the fluid injection lances 98, 100 are advanced to a second inserted position which is approximately two thirds of the container length, and the lance air is increased to a second air rate by further opening of the valve 30A. This position is maintained for a preset time, and the fluid injection lances 98, 100 are advanced to a third and final position which is fully into the waste containers and the lance air is increased to a third air rate.

When the temperature controller 64 detects an increase of the overhead vapor stream temperature from the pyrolysis furnace 12 in excess of a predetermined set point, the timing cycle which controls the advancement of the fluid injection lances 98, 100 is temporarily interrupted until the temperature in the overhead vapor stream is reduced to below the desired set point. Then the temperature controller 6 initiates reactivation of the timing cycle which controls advancement of the fluid injection lances 98, 100. Further, to provide for the safe destruction of the waste materials during the pyrolytic phase, an inert coolant fluid can be injected into the pyrolysis furnace 12 (and thus into the waste materials disposed therein) in response to the monitoring of the temperature overhead vapor line 18 by the temperature controllers 64, 66 and the detection that an unacceptable temperature increase in the pyrolysis furnace 12 has been achieved. The air flow via the fluid injection lances 98, 100 and the fuel via line 56, and fuel valve 58 will be halted and the inert coolant fluid injected into the pyrolysis furnace 12 until the temperature of the overhead vapor line 18 returns to an acceptable value as determined by the temperature controllers 64, 66.

The length of the timing cycle, as well as the incremental advances, of the fluid injection lances 98, 100 is determined empirically by examination of results achieved during operational runs of the system 10. With experience, the timing cycle will be established such that all of the combustibles are pyrolyzed and the continued passage of lance air makes the last portion of the cycle performed with the fluid injection lances 98, 100 occur in an oxidizing atmosphere. Once this is reached in an operational cycle of the pyrolysis furnace 12, and the cycle time has expired, the following occur: the radiant burner will shut off (via stopping fuel in line 56 and air in line 60); lance air is stopped (by shutting valve 30A); the fluid injection lances 98, 100 are retracted; and the pyrolysis furnace 12 is cooled by introducing cooling steam into the pyrolysis furnace 12 via line 24 and valve 26 for a selected cooling period.

Residual ash, if present, is removed during the recharge of the pyrolysis furnace 12. Further, the final oxidation step of the process carried out in the pyrolysis furnace 12 removes any residual pyrolysis products from the surface of the refractory of the pyrolysis furnace 12.

The pyrolysis furnace 14 is operated in an identical manner to that of the pyrolysis furnace 12. Thus, with the exception of the identity of the valves and lines of the pyrolysis furnace 14 utilized in the operation of the pyrolysis furnace 12, all other components of the pyrolysis furnace 14 bear the same numerals as that heretofore described with reference to the pyrolysis furnace 12 and operate in a similar manner.

Referring now to FIGS. 2–4, the pyrolysis furnace 12 is illustrated in more detail. As previously stated, the pyrolysis furnaces 12 and 14 are identical in construction and operation. Thus, only the pyrolysis furnace 12 will be described hereinafter in detail.

The pyrolysis furnace 12 is provided with a housing 80 having a combustion chamber 82 and an opening 84 in a lower portion 86 thereof openly communicating with the combustion chamber 82. Thus, containers, such as barrels 88 and 90 (which contain the waste material to be thermally destroyed) can be positioned within the combustion chamber 82 of the housing 80 via the opening 84. The pyrolysis furnace 12 is also provided with wells 92 and 94 in an upper portion 96 of the housing 80 which are adapted to receive the fluid injection lances 98 and 100, respectively, such that the fluid injection lances 98 and 100 can be selectively advanced into the barrels 88 and 90 (and thus penetrate the material waste contained therein) at a predetermined rate to insure complete and efficient pyrolysis and oxidation of the waste materials as will be discussed in more detail hereinafter.

The pyrolysis furnace 12 further includes a plurality of conduits, such as conduits 102 and 104, for establishing communication between the lower portion 86 and the upper portion 96 of the housing 80 so that gases generated by the radiant burner can be directed into the upper portion 96 and exhausted as an overhead vapor stream via outlet conduit 106. The pyrolysis furnace 12 is also provided with a plurality of other conduits, such as conduits 108, 110, 112, 114 and 116, for injecting various fluids into the pyrolysis furnace 12 during the operation of the pyrolysis furnace 12, or for controlling the rate of combustion within the combustion chamber 82 (and thus the temperature and rate of the overhead vapor stream exiting through outlet conduit 106 to the secondary combustor, not shown), or during the "cool down" of the pyrolysis furnace 12. That is, the conduits 108–112 supply sweep air, inert gas and cooling steam to the pyrolysis furnace 12 for controlling the temperature of the overhead stream, the temperature at which the pyrolysis furnace 12 is operated (and thus the rate of pyrolysis of the waste materials), and to effect efficient "cool down" of the pyrolysis furnace 12. On the other hand, the conduits 114 and 116 provide air and fuel gas for a radiant burner 118 disposed within the combustion chamber 82.

The fluid injection lances 98 and 100, which are designed to extend into barrels 88 and 90, respectively, are each connected to the upper portion 96 of the housing 80 via the wells 92 and 94 so that a fluid-tight seal is formed between the wells 92 and 94 and the fluid injection lances 98 and 100. Further, the wells 92 and 94 are designed such that the fluid injection lances 98 and 100 can be selectively moved between a raised and a lowered position through the wells 92, 94, respectively, and thus into the waste material disposed in the barrels 88 and 90 substantially as shown in FIGS. 2–4. Any suitable means can be employed for the raising and lowering of the fluid injection lances 98 and 100, such as hydraulic cylinder assemblies designated by the numerals 120 and 122.

The pyrolysis furnace 12 further comprises a closure member 124 for closing the opening 84 to the combustion chamber 82 of the housing 80, and a locking assembly 126 for securing the closure member 124. To provide a gas-tight seal between the closure member 124 and the housing 80, an outwardly disposed lip 128 extends about the opening 84; and the closure member 124 is provided with a recess 130 which is adapted to matingly receive the lip 128. A gasket 132 (see FIG. 5) is disposed within the recess 130 of the closure member 124 in order to enhance the formation of a fluid or gas-tight seal between the closure member 124 and the lip 128.

Figure 5:
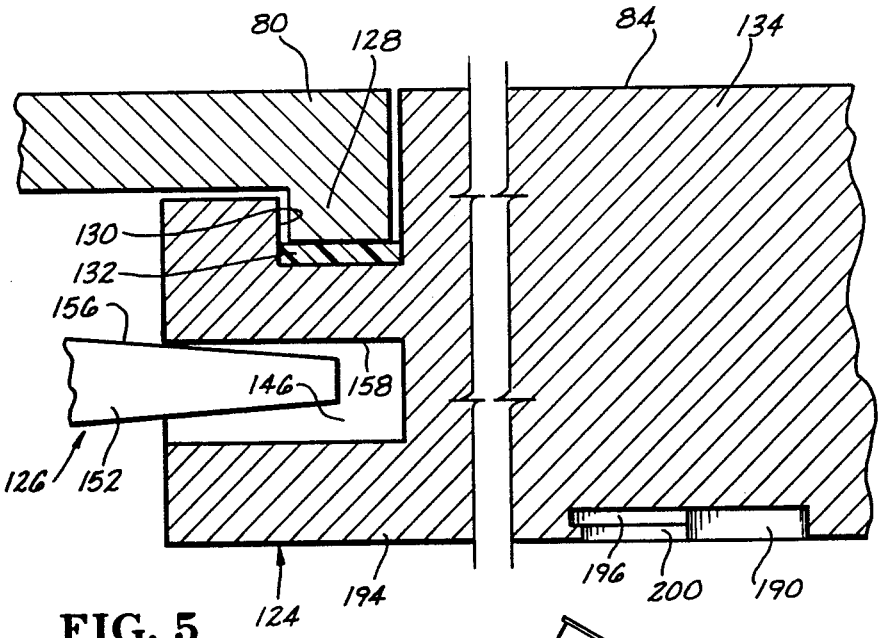
FIG. 5 is a fragmentary, cross-sectional view of one end of the closure assembly of the pyrolysis furnace and illustrating the interconnection of the closure assembly and a locking assembly.

The closure member 124 is further provided with an upper portion 134 which is positioned within the opening 84 (FIGS. 3–5). A plurality of upwardly extending, spatially disposed chair-like members 136 are secured to the upper portion 134 of the closure member 124, the chair-like member 136 adapted to receive and support a lower end of the barrels 88 and 90. Thus, the chair-like member 136 stabilize the barrels 88 and 90 when the closure member 124 is moved into the closing position relative to the opening 84 and secured therein by activation of the locking assembly 126.

The closure member 124 is connectable to a rail truck assembly 140 having a tiltable table and lift 142. Thus, to position the barrels 88 and 90 in the combustion chamber 82 of the pyrolysis furnace 12, the closure member 124 is connected to the tiltable table and lift 142 and the barrels 88 and 90 are positioned on the closure member 124 such that the chair-like member 136 engage the lower ends of the barrels 88 and 90. The closure member 124 is then aligned with the opening 84 to the combustion chamber 82. Thereafter, activation of a scissor-lift 144 lifts the closure member 124 into sealing, closing engagement with the opening 84. While maintaining the closure member 124 at the desired closing position, the locking assembly 126 is activated to selectively engage the closure member 124. Once the locking assembly 126 has been actuated and engages the closure member 124, the closure member 124 can be separated from the tiltable table and lift 142 of the rail truck assembly 140, and the scissor-lift 144 moved to the retracted position, so that the rail truck assembly 140 can be moved to another location.

Referring more specifically to FIGS. 3–5, the interconnection of the closure member 124 and the locking assembly 126 will be described. The closure member 124 is provided with a locking cavity 146 disposed about the periphery of the closure member 124 which is adapted to receive the locking assembly 126 when the closure member 124 is positioned in a closed, sealing position relative to opening 84.

The locking assembly 126 comprises a plurality of spatially disposed double acting rams, such as rams 148 and 150. The rod end of each of the rams, such as rod ends 152 and 154 of the rams 148, 150, respectively, are provided with a camming surface extending along an inclined plane of each of the rod ends. That is, when the rams of the locking assembly 126 are activated, the rod members of the rams extend into the locking cavity 146 such that a camming surface 156 of the rod end 152 engages a shoulder 158 formed along an upper portion of the locking cavity 146 (FIG. 5). The engagement of the shoulder 158 and the camming surface 156 of the rod end 152 exerts an upward force on the closure member 124 to enhance the seal between the lip 128 disposed about the opening 84, the gasket 132 and the recess 130 of the closure member 124. That is, as pressure is exerted on the shoulder 158 of the locking cavity 146 by the camming surface 156 of the rod end 152, the closure member 124 is forced upwardly into engagement with the lip 128 so that a fluid-tight seal is formed between the lip 128, the gasket 132 and the recess 130 of the closure member 124.

Figure 6:
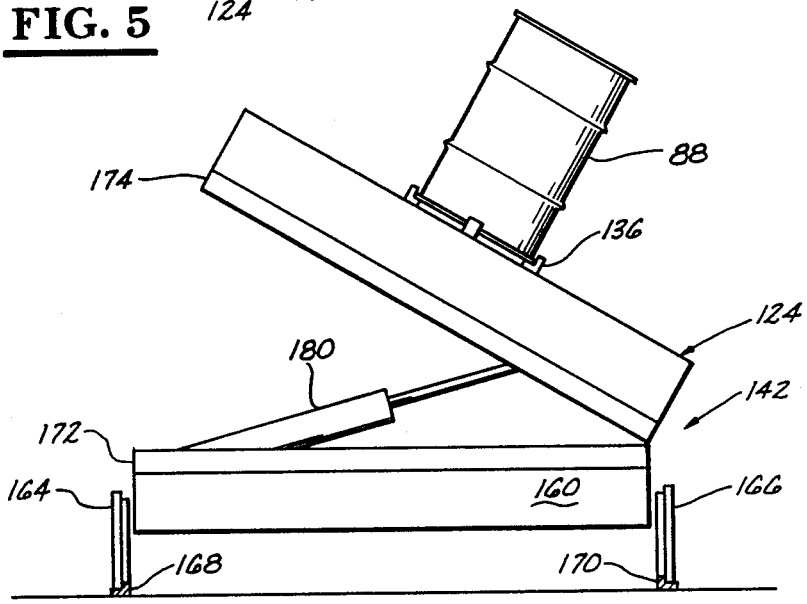
FIG. 6 is an elevational view of the rail truck assembly wherein an upper disposed support member is in a tilted position.

Referring now to FIGS. 2, 3 and 6, the rail truck assembly 140 comprises a truck body portion 160 supported by a plurality of wheels (only three of such wheels 162, 164 and 166 being shown) which are rotatably mounted on the truck body portion 160 by any suitable means, such as an axle. The wheels can be adapted to travel along a pair of spatially disposed rail members 168 and 170 as shown, or any other suitable means for permitting movement of the rail truck assembly 140 along a supporting surface.

The rail truck assembly 140 further comprises an intermediate support member 172 and an upper disposed support member 174 which is pivotally connected along one side to the intermediate support member 172 by a plurality of hinges (not shown). The scissor-lift 144 is disposed between and connected to the truck body portion 160 and the intermediate support member 172 such that upon activation of the scissor-lift 144, the scissor-lift 144 can be selectively moved between a lower or retracted position (FIG. 2) and a raised or extended position (FIG. 3). Scissor-lifts, such as the scissor-lift 144, are well known and commercially available units, as are the power assemblies for actuating such lifts. Thus, no further comments are deemed necessary to allow one skilled in the art to understand the connection of the scissor-lift 144 to the truck body portion 160 and the intermediate support member 172, or the operation of the scissor-lift 144.

As previously stated, the upper disposed support member 174 (which is adapted to receive and support the closure member 124 thereon) is pivotally connected to the intermediate support member 172. To effect the tiltable feature of the tiltable table and lift 142, the rail truck assembly 140 further comprises a pair of hydraulic actuated rams 180 and 182 disposed between and connected to the intermediate support member 172 and the upper support member 174. Thus, upon actuation of the rams 180 and 182, the upper disposed support member 174 is pivotally moved to an angularly disposed position (FIG. 6) to assist in removal of the barrels 88 and 90 from the closure member 124 when the closure member 124 is connected to the rail truck assembly 140.

Figure 7:
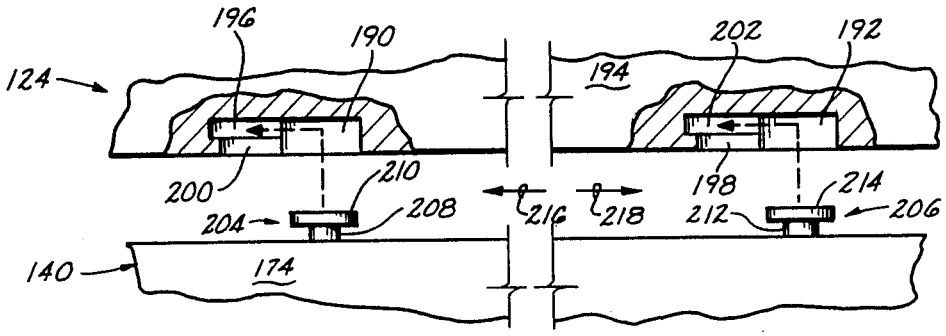
FIG. 7 is a fragmentary isometric view illustrating the connecting members for securing the closure assembly of the pyrolysis furnace to the upper disposed support member of the rail truck assembly.

To insure that the closure member 124 is secured in a stable position on the tiltable table and lift 142 (while at the same time permitting the closure member 124 to be disconnected and removed from the tiltable table and lift 142 when the closure member 124 is locked in position by the locking assembly 126), the closure member 124 is provided with a plurality of key hole shaped openings, such as key hole shaped openings 190 and 192 formed in a lower side 194 thereof (see FIGS. 5 and 7). One end portion of each of the key hole shaped openings, such as end portions 196 and 198 of the key hole shaped openings 190 and 192, respectively, are provided with shoulders 200 and 202 which define a slot.

The upper disposed support member 174 of the tiltable table and lift 142 is provided with a plurality of connector members, such as connector members 204 and 206 (FIG. 6) which are positionable in the key hole shaped openings 190, 192 of the closure member 124 and slideable through the slots defined by the shoulders 200, 202 thereof for securing the closure member 124 to the upper disposed support member 174. That is, the connector member 204 is provided with an upright post member 208 having an enlarged head portion 210; and the connector member 206 is provided with an upright post member 212 having an enlarged head portion 214.

To connect the closure member 124 to the upper disposed support member 174, the enlarged head portion 210 of the connector member 204 is positioned in the enlarged end portion of the key hole shaped opening 190; and the enlarged head portion 214 of the connector member 206 is positioned in the enlarged end portion of the key hole shaped opening 192. Thus, when the upright post member 208 is caused to slidingly move through the slot defined by the shoulders 200 of the end portion 196 of the key hole shaped opening 190 in the direction of the arrow 216, and the upright post member 212 is caused to slidingly move through the slot defined by the shoulder 202 of the end portion 198 of the key hole shaped opening 192 in the direction of the arrow 216, the enlarged head portions 210 and 214 of the connector members 204 and 206 abuttingly engage the shoulders 200 and 202 and thereby secure the closure member 124 to the upper disposed support member 174.

To disconnect the closure member 124 from the upper disposed support member 174 (when the closure member 124 is secured to the housing 80 for closing the opening 84 to the combustion chamber 82 of the pyrolysis furnace 12 as shown in FIGS. 3 and 4) a force is directed on the rail truck assembly 140 so as to slideably move the upright post member 208 through the slot defined by the shoulder 200 of the end portion 196 of the key hole shaped opening 190 in the direction of the arrow 218; and to slideably move the upright post member 212 through the slot defined by the shoulder 202 of the end portion 198 of the key hole shaped opening 192 in the direction of the arrow 218. The enlarged head portions 210 and 214 of the connector members 204 and 206 can then be removed from the key hole shaped openings 190 and 192 so that the closure member 124 is disconnected from the upper disposed support member 174, and thus the rail truck assembly 140.

It should be clear from the above-described process for the safe destruction of toxic substances of unknown volatility, as well as the improved primary combustors employed in such process, that one can safely and efficiently handle containers filled with unknown materials utilizing the process wherein pyrolysis is performed with a reducing atmosphere until all materials are pyrolyzed, and thereafter the temperature is maintained through an oxidizing period until all combustible materials are destroyed. Further, another unique feature of the process is that the operation of the pyrolysis furnace is controlled by the rate of volatilization of products occurring within the pyrolysis furnace as well as the rate and temperature of products of combustion of materials combusted within the pyrolysis furnace. Thus, not only does the process and the pyrolysis furnace provide a safe means to handle volatile, flammable materials in a batch destruction process, but at the same time to supply a uniform load to the secondary combustor to allow the secondary combustor to be as small as possible and yet operate near peak thermal efficiency. Thus, the present invention is well adapted to carry out the objects and attain the ends and advantages mentioned as well as those inherent therein. While presently preferred embodiments have been described for purposes of this disclosure, numerous changes may be made which will readily suggest themselves to those skilled in the art, and which are embodied within the spirit of the invention disclosed and as defined in the appended claims.

What is claimed is:

1. A process for the safe destruction of toxic substances of unknown volatility, the process comprising the steps of:

providing an opening in a container of the toxic substances to serve as a vapor outlet;

placing the container of toxic substances in a pyrolysis furnace having a variable heat source;

providing vapor communication from the vapor outlet of the container to a secondary combustor;

providing heat to the container with the variable heat source to vaporize volatile constituents of the toxic substances in the container so that an overhead vapor stream is passed to the secondary combustor;

monitoring the temperature of the overhead vapor stream;

controlling the heat provided to the container in response to the temperature of the overhead stream so that the overhead stream is caused to increase at a controlled rate; and inserting a fluid injection lance into the container via the vapor outlet of the container such that controlled amounts of air can be injected into the toxic substances in the container in response to the temperature of the overhead vapor stream reaching a predetermined value, the fluid injection lance being sequentially advanced in the container so that the depth of penetration of the air is increased at a predetermined rate.

2. The process of claim 1 further comprising the step of:

interrupting the advancement of the fluid injection lance in response to an increase of the overhead vapor stream temperature in excess of a predetermined rate of temperature increase.

3. The process of claim 2 further comprising the step of:

ceasing the air flow and injecting an inert coolant fluid into contact with the toxic substances by the fluid injection lance in response to the step of monitoring the overhead vapor stream temperature detecting an unacceptable temperature increase until the temperature of same returns to an acceptable value.

4. The process of claim 3 further comprising the step of:

alternating the steps of heating and injecting coolant fluid so that the temperature of the overhead vapor stream is controlled within an acceptable temperature range.

5. The process of claim 4 wherein the overhead vapor stream is passed to the secondary combustor which has a flame maintained by a source of fuel and combustion air, and wherein the vapor communication from the vapor outlet of the container is to the secondary combustor so that the overhead vapor stream is passed to the flame zone in the secondary combustor, and the products of combustion are exhausted from the secondary combustor as an overhead exhaust stream, the process further comprising the steps of:

monitoring the temperature of the overhead exhaust stream from the secondary combustor; and maintaining a constant input vapor load to the secondary combustor in response to the monitored temperature of the overhead exhaust stream.

6. The process of claim 5 further comprising:

purging the pyrolysis furnace to provide a nonreacting atmosphere prior to heating the container therein.

7. The process of claim 6 further comprising:

reducing the pressure in the pyrolosis furnace while injecting steam therein to provide the inert atmosphere in the pyrolysis furnace.

8. The process of claim 7 wherein the pyrolysis furnace has been maintained at an elevated temperature for a period of time to effect pyrolysis of the materials in the container, and the process further comprises the steps of:

halting the flow of fuel to variable heat source; injecting air into the pyrolysis furnace to cool down the pyrolysis furnace and the container; and removing the cooled container from the pyrolysis furnace.

9. A process for the safe destruction of toxic substances of unknown volatility, the process comprising the step of:

placing an open container of toxic substances in a gas tight pyrolysis furnace having a variable radiant heat source, the pyrolysis furnace having a vapor outlet formed therein which is openly communicating with the container;

providing vapor communication from the vapor outlet of the pyrolysis furnace to a secondary combustor;

purging the pyrolysis furnace to provide an inert atmosphere in the pyrolysis furnace;

heating the container with the variable heat source to a predetermined temperature so as to vaporize volatile constituents of the toxic substances in the container and provide an overhead vapor stream constituting the volatile constituents;

passing the overhead gas stream to a secondary combustor via the vapor outlet;

injecting controlled amounts of air into the container after the pyrolysis furnace has reached the predetermined temperature;

monitoring the temperature of the overhead vapor stream; and controlling the temperature of the pyrolysis furnace in response to the temperature of the overhead stream so that the overhead stream is caused to increase at a controlled rate.

10. The process of claim 9 wherein the step of injecting controlled amounts of air is performed with a fluid injection lance which is advanceable into the pyrolysis furnace and into the open container of toxic substances, and wherein the process further comprises the step of:

advancing the fluid injection lance into the container to penetrate the toxic substances so that the depth of penetration is increased at a predetermined rate.

11. The process of claim 10 further comprising the step of:

interrupting the advancement of the fluid injection lance in response to an increase of the overhead vapor stream temperature in excess of a predetermined rate of temperature increase.

12. The process of claim 11 further comprising the step of:

ceasing the air flow and injecting an inert coolant fluid into contact with the toxic substances by the fluid injection lance in response to the step of monitoring the overhead vapor stream temperature detecting an unacceptable temperature increase until the temperature of same returns to an acceptable value.

13. The process of claim 12 further comprising the step of:

alternating the steps of injecting inert coolant fluid and injecting coolant fluid so that the temperature of the overhead vapor stream is controlled within an acceptable temperature range.

14. The process of claim 13 wherein the overhead vapor stream is passed to the secondary combustor which has a flame maintained by a source of fuel and combustion air, and wherein the vapor communication between the vapor outlet of the pyrolysis furnace and the secondary combustor is such that the overhead vapor stream is passed to the flame zone in the secondary combustor and the products of combustion from the secondary combustor are exhausted as an overhead exhaust stream, the process further comprising the steps of:

monitoring the temperature of the overhead exhaust stream from the secondary combustor; and maintaining a constant input material load to the secondary combustor in response to the monitored temperature of the overhead exhaust stream.

15. The process of claim 14 further comprising:

providing an opening in an upper portion of the container prior to placing the container in the pyrolysis furnace.

16. The process of claim 15 further comprising reducing the pressure in the pyrolysis furnace while purging the pyrolysis furnace with steam.

17. The process of claim 16 further comprising the steps of:

reducing the temperature of the pyrolysis furnace after all volatile constituents have been removed from the toxic substance and remaining materials in the container have been pyrolyzed; and removing the container from the pyrolysis furnace.

18. A pyrolysis furnace for achieving thermal destruction of waste materials of unknown volatility and composition wherein the waste materials are disposed in open container, the pyrolysis furnace comprising:

a housing having a combustion chamber, an opening communicating with the combustion chamber for positioning of containers therein, and a vapor outlet;

radiant burner means disposed within the combustion chamber for heating the combustion chamber and the waste materials positioned therein;

closure means for closing the opening in the housing and for supporting the open containers within the combustion chamber;

locking means for securing the closure means to the housing such that a fluid-tight seal is formed between the housing and the closure means;

fluid lance injection means for injecting controlled amounts of air into the waste material in the open containers; and means for advancing the fluid injection lance means to penetrate the waste materials such that the depth of penetration of the waste materials by the fluid injection lance means is increased at a predetermined rate.

19. The pyrolysis furnace of claim 18 further comprising:

means for monitoring temperature in an overhead vapor stream passing from the housing through the vapor outlet; and control means for controlling the temperature in the combustion chamber in response to the temperature of the overhead vapor stream such that the temperature of the overhead vapor stream is increased at a controlled rate.

20. The pyrolysis furnace of claim 19 wherein the closure means is provided with a recess disposed in an upper surface thereof and wherein the pyrolysis furnace further comprises:

an outwardly disposed lip extending from the housing about the opening therein and adapted to be matingly disposed within the recess of the closure means when the closure means is positioned within the opening of the housing; and gasket means disposed within the recess for enhancing formation of a gas-tight seal between the outwardly disposed lip and the recess of the closure means.

21. The pyrolysis furnace of claim 20 wherein the closure means is provided with a locking cavity disposed about the periphery of the closure means, and wherein the locking means comprises a plurality of spatially disposed double acting rams, each ram having a rod end defining a camming surface extending along an inclined plane thereof adapted to engage an upwardly disposed shoulder formed in the closure means by the locking cavity when the double acting rams are activated to engage the closure means and secure same in a sealing position relative to the opening in the housing.

* * * * *